US012320074B2

(12) United States Patent
Dag et al.

(10) Patent No.: US 12,320,074 B2
(45) Date of Patent: Jun. 3, 2025

(54) BIODEGRADABLE THREE-DIMENSIONAL PRODUCTS MOLDED FROM NATURAL FIBERS

(71) Applicant: PAPACKS SALES GMBH, Cologne (DE)

(72) Inventors: Tahsin Dag, Cologne (DE); Florian Barth, Cologne (DE)

(73) Assignee: PAPACKS SALES GMBH, Cologne (DE)

( * ) Notice: Subject to any disclaimer, the term of this patent is extended or adjusted under 35 U.S.C. 154(b) by 0 days.

(21) Appl. No.: 18/627,747

(22) Filed: Apr. 5, 2024

(65) Prior Publication Data

US 2024/0352678 A1 Oct. 24, 2024

(30) Foreign Application Priority Data

Apr. 24, 2023 (DE) ..... 102023110435.7

(51) Int. Cl.
*D21J 5/00* (2006.01)
*D21F 13/00* (2006.01)
(Continued)

(52) U.S. Cl.
CPC ..... *D21J 5/00* (2013.01); *D21F 13/00* (2013.01); *D21H 11/12* (2013.01); *D21J 1/04* (2013.01); *D21J 1/06* (2013.01); *D21J 1/08* (2013.01)

(58) Field of Classification Search
CPC ..... D21J 5/00; D21J 1/04; D21J 1/06; D21J 1/08; D21H 11/12; D21F 13/00
See application file for complete search history.

(56) References Cited

U.S. PATENT DOCUMENTS 3,922,191 A 11/1975 Witt et al.
11,420,784 B2 8/2022 Parker et al.
(Continued)

FOREIGN PATENT DOCUMENTS

DE 2449953 A1 11/1975
DE 102019127556 A1 * 4/2021 ..... B65D 85/8043
(Continued)

OTHER PUBLICATIONS

English translation of DE102019127556A1 retrieved from espacenet (Year: 2024).*
(Continued)

*Primary Examiner* — Jacob T Minskey
*Assistant Examiner* — Elisa H Vera
(74) *Attorney, Agent, or Firm* — NEO IP

(57) ABSTRACT

The present invention is directed to methods and systems for manufacturing molded fiber products using a pulp slurry and apparatus submerged in pulp slurry. The system utilizes a vacuum and mesh shaping of the product to pull fiber from the pulp slurry to the mesh shape while sucking the water through the mesh shape. The molded fiber product is then pressed to bolster the strength and structure of the product. The product is then coated using centripetal force to uniformly spread the coating across the selected area of the product. After coating, the product is pressed again to ensure the waterproof and airproof structure of the product. The materials used in manufacturing the molded fiber product are biodegradable, and the apparatus to form the molded fiber product is shaped according to the desired shape and size of the product.

9 Claims, 13 Drawing Sheets

(51) Int. Cl.

| | |
|---|---|
| ***D21H 11/12*** | (2006.01) |
| ***D21J 1/04*** | (2006.01) |
| ***D21J 1/06*** | (2006.01) |
| ***D21J 1/08*** | (2006.01) |

(56) References Cited

U.S. PATENT DOCUMENTS

| | | | | |
|---|---|---|---|---|
| 11,479,919 | B2 | 10/2022 | Parker et al. | |
| 11,673,737 | B2 | 6/2023 | Appleford et al. | |
| 2001/0040016 | A1 | 11/2001 | Kumamoto et al. | |
| 2020/0277738 | A1 | 9/2020 | Chung et al. | |
| 2021/0164171 | A1 | 6/2021 | Kuiper | |
| 2021/0261310 | A1 | 8/2021 | Kuiper et al. | |
| 2021/0269983 | A1 | 9/2021 | Pierce | |
| 2022/0049429 | A1 | 2/2022 | Chung et al. | |
| 2022/0064858 | A1 | 3/2022 | Imai et al. | |
| 2022/0081847 | A1 | 3/2022 | Pierce | |
| 2022/0259805 | A1 | 8/2022 | Dag | |
| 2022/0364313 | A1 | 11/2022 | Pande et al. | |
| 2024/0200269 | A1* | 6/2024 | Peter | B27N 5/02 |

FOREIGN PATENT DOCUMENTS

| | | | | | |
|---|---|---|---|---|---|
| EP | 1104822 | A2 | | 6/2001 | |
| EP | 1126083 | A1 | | 8/2001 | |
| EP | 1221413 | A1 | | 7/2002 | |
| EP | 1439264 | A1 | * | 7/2004 | D21J 3/10 |
| GB | 308343 | A | | 11/1929 | |
| JP | 2000000806 | A | * | 1/2000 | |
| JP | 3807877 | B | | 8/2006 | |
| JP | 3970173 | B | | 9/2007 | |
| JP | 2018087393 | A | * | 6/2018 | |
| WO | 2009034344 | A2 | | 3/2009 | |
| WO | 2022258697 | A1 | | 12/2022 | |

OTHER PUBLICATIONS

English translation of JP2018087393A retrieved from espacenet. (Year: 2024).*

JP2000000806A English Description retrieved from Espacenet (Year: 2024).*

DE Office Action Dec. 2, 2024.

* cited by examiner

BIODEGRADABLE THREE-DIMENSIONAL PRODUCTS MOLDED FROM NATURAL FIBERS

CROSS REFERENCES TO RELATED APPLICATIONS

This application is related to and claims priority to one or more prior filed patent applications. This application claims priority to and the benefit of German Application No. DE 102023110435.7, filed Apr. 24, 2023, which is incorporated herein by reference in its entirety.

BACKGROUND OF THE INVENTION

1. Field of the Invention

The present invention relates to methods and systems of manufacturing molded fiber products, and more specifically to the pressing and coating of moisture-resistant molded fiber products.

2. Description of the Prior Art

It is generally known in the prior art to provide methods of forming pulp products for a variety of food and nonfood applications using wet laid processes or thermal binding.

Prior art patent documents include the following:

US Patent Pub. No. 2021/0269983 for Method of producing a pulp product by inventor Pierce, filed Jan. 18, 2021, and published Sep. 2, 2021, is directed to a method of producing a 3D molded product from a pulp slurry. The method comprises applying a pulp slurry layer to a porous forming face of a first mold, in a first forming step, pressing the pulp slurry layer against the porous forming face of the first mold, while heating the pulp slurry layer and drawing a vacuum through the porous forming face of the first mold, transferring the pulp slurry layer to a porous forming face of a second mold, in a second, subsequent, forming step, pressing the pulp slurry layer against the porous forming face of the second mold, while heating the pulp slurry layer and drawing a vacuum through the porous forming face of the second mold. In the method, a first pressure at the rear side of the forming face of the porous forming face of the first mold is lower than a second pressure at the rear side of the porous forming face of the second mold.

US Patent Pub. No. 2022/0259805 for Barrier layer for cellulose substrate by inventor Dag, filed Apr. 20, 2020, and published Aug. 18, 2022, is directed to a method for the production of coated substrates, in which a flowable, biologically degradable first coating which enhances gas tightness is applied to a cellulose-containing substrate. To obtain a packaging consisting only of natural components and offering good tightness, a second water-tight coating made of animal and/or vegetable waxes and/or lipids is applied to the first coating.

US Patent Pub. No. 2022/0064858 for Cellulose fiber molded product and method for manufacturing the same by inventors Imai, et al., filed Mar. 10, 2021, and published Mar. 3, 2022, is directed to providing a cellulose fiber molded product having improved tensile elastic modulus, preferably a cellulose fiber molded product also having improved tensile strength, and a method for manufacturing the same. A cellulose fiber molded product contains cellulose fibers as the main component, in which the cellulose fibers contain pulp and defibrated fibers, and the defibrated fibers contain microfibrillated cellulose. For manufacturing the molded product, a cellulose fiber slurry is prepared using the pulp and the defibrated fibers, wet paper is formed from the cellulose fiber slurry, and the wet paper is dehydrated, pressurized, and heated. At this time, as the defibrated fibers, microfibrillated cellulose, or microfibrillated cellulose and cellulose nanofibers are used.

U.S. Pat. No. 11,479,919 for Molded articles from a fiber slurry by inventors Parker, et al., filed Jul. 26, 2019 and issued Oct. 25, 2022, is directed to contoured articles formed in a mold from a fiber slurry. The articles comprise a blend of cellulose fibers and cellulose ester, such as cellulose ester staple fibers. The articles are suitable in a wide array of end uses, including as cups, lids, boxes or pouches, storage containers, trays, plates, food trays, cutlery, coffee cups, coffee cup lid, packaging, bowls, clam shells, bottle caps, straws, covers, and packaging inserts.

U.S. Pat. No. 11,420,784 for Food packaging articles by inventors Parker, et al., filed Jul. 26, 2019, and issued Aug. 23, 2022, is directed to containers and lids made from cellulose fibers and cellulose ester fibers that have enhanced air permeability, stiffness, R-heat insulation values, or thickness at equivalent grammage basis weights are provided, or alternatively, maintaining one or more of these properties while lowering the basis weight of the containers or lids. The container and lids with this synthetic fiber can be biodegradable when made with cellulose ester fibers having a degree of substitution of not more than 2.5. Examples of such containers are food packaging such as hot or cold delivery boxes.

US Patent No. 2021/0164171 for Method and System for Manufacturing a 3-Dimensional Food Packaging Unit from a Molded Pulp Material and Such Food Packaging Product by inventor Kuiper, filed Jun. 5, 2020, and issued Jun. 3, 2021, is directed to a method and system for manufacturing a 3-dimensional packaging material form a moulded pulp material and such packaging unit. The method of the invention comprises the steps of: —preparing a pulp material, comprising the steps of: —providing an amount of biomass with non-wood biomass fibers as a raw material; preparing the biomass fibers; fibrillation of the prepared biomass fibers with an extruder to produce the pulp material with biomass fibers; providing the pulp material to the moulding device; moulding the 3-dimensional food packaging unit; and releasing the 3-dimensional food packaging unit from the mould.

U.S. Pat. No. 11,673,737 for Dispensing capsule and method and apparatus of forming same by inventors Appleford, et al., filed Mar. 12, 2019, and issued Jun. 13, 2023, is directed to an apparatus for high speed continuous thermoforming of pulp materials into pulp based products including a beverage dispensing capsule comprising a body having a side wall and a base formed entirely of moulded pulp fibres, said apparatus comprising a holding tank for water and pulp fibres in suspension, a continuous feed belt of articulated mesh toolsets contoured to the preform shape of said products, said belt being inclined to allow partial immersion and partial withdrawal from said suspension by continuous rotation of said belt, vacuum means applied to said mesh toolsets to draw said pulp fibres onto said mesh toolsets immersed in said suspension to form a preform pulp mat of said product.

US Patent Pub. No. 2020/0277738 for Acrylate and Non-Acrylate Based Chemical Compositions For Selectively Coating Fiber-Based Food Containers by inventors Chung, et al., filed May 18, 2020, and published Sep. 3, 2020, is directed to Methods and apparatus for vacuum forming and subsequently applying topical coatings fiber-based food containers. The slurry includes one or more of an embedded moisture barrier, vapor barrier, and oil barrier, and the topical coating comprises one or more of a vapor barrier, a moisture barrier, an oil barrier, and an oxygen barrier, for example polyvinyl alcohol, sugar alcohol, citric acid, and cellulose nanofibrils.

US Patent Pub. No. 2022/0049429 for Fiber-based food containers by inventors Chung, et al., filed Oct. 28, 2021, and published Feb. 17, 2022, is directed to methods and apparatus for manufacturing a microwavable food container include: forming a wire mesh over a mold comprising a mirror image of the microwavable food container; immersing the wire mesh in a fiber-based slurry bath; drawing a vacuum across the wire mesh to cause fiber particles to accumulate at the wire mesh surface; and removing the wire mesh including the accumulated fiber particles from the slurry bath; wherein the slurry comprises one or more of a moisture barrier, an oil barrier, and a vapor barrier.

US Patent Pub. No. 2021/0261310 for Biodegradable and Compostable Food Packaging Unit from a Moulded or Fluff Pulp Material with a Laminated Multi-Layer, and Method for Manufacturing Such Food Packaging by inventors Kuiper, et al., filed Jan. 15, 2021, and published Jan. 7, 2020, is directed to a biodegradable food packaging unit from a moulded or fluff pulp material and a method for manufacturing such biodegradable packaging unit. The packaging according to the invention comprises a food receiving and/or carrying compartment that comprises a biodegradable laminated multi-layer, with the multi-layer comprising: —an inner cover layer comprising an amount of a biodegradable aliphatic polyester; —a first intermediate layer of a biodegradable material for connecting and/or sealing adjacent layers; —a functional layer comprising a vinyl alcohol polymer; —a second intermediate layer of a biodegradable material for connecting and/or sealing adjacent layers; and—an outer cover layer comprising an amount of a biodegradable aliphatic polyester, and wherein the food packaging unit is a compostable food packaging unit.

US Patent Pub. No. 2022/0081847 for Device and method for producing a 3d molded pulp product by inventor Pierce, filed Jun. 30, 2021, and published Mar. 17, 2022, is directed to a device for producing a 3D molded product from a pulp slurry, comprising a pair of cooperating press tools, each having a respective product face. The press tools are movable relative each other between a closed press position, wherein the product faces are sufficiently close to press the pulp product there between, and an open transfer position, wherein the pulp product can be removed from the product face of one of the press tools. At least one of the product faces is porous. The device further comprises a radiation heater, which is adapted to radiate heat towards the product face of the porous press tool, when the porous press tool is in its open position.

US Patent Pub. No. 2022/0364313 for Molded pulp products incorporating surface enhanced pulp fibers and methods of making the same by inventors Pande, et al., filed Apr. 7, 2022, and published Nov. 17, 2022, is directed to a method of pulp product manufacture includes spraying a surface enhanced pulp fiber (SEPF) coating on at least a portion of a molded pulp product, the SEPF coating comprising SEPF having a length weighted average fiber length that is at least 0.20 millimeters (mm) and an average hydrodynamic specific surface area that is at least 10 square meters per gram (m2/g).

Japanese Patent No. 3,807,877 for Pulp-molded body by inventors Tsuura et al., filed Jul. 19, 1999 and issued Aug. 9, 2006, is directed to a pulp-molded body that is readily foldable on disposal without formation of folding lines on the outer surface of the vessel, and provide a method for producing pulp-molded body that can readily produce any type of molded bodies without limitation of their shapes. This pulp-molded body is a hollow molded body 10 that has the recessed part on the inner surface of the hollow drum body. In one embodiment, a plurality of holes are formed on the pulp-screening face of the paper-making mold and the pulp fibers are stacked on the pulp-screening face to form a pulp-laminated body. Then, the pulp-laminated body is drained and dried to produce the objective pulp-molded body. In this case, the holes are not formed partially on pulp-screening face to make the wall thickness in the part corresponding to the recessed part thin in the vessel.

Japanese Patent No. 3,970,173 for Method for producing pulp molded article by inventors Goto et al., filed Dec. 2, 2002 and issued Sep. 5, 2007, is directed to a lightweight pulp molded form excellent in moldability and thermal insulation, having high mechanical strength and excellent in disposability as well. The pulp molded form has the following structure: the thickness is changed from a thin-walled portion 23 via stacking level differences 22 to a thick-walled portion 24, and the density at the proximity 23a of the level differences 22 at the thin-walled portion 23 is higher than the density at the other portions of the proximity 23a at the thin-walled portion 23 and not lower than the density at the thick-walled portion 24.

SUMMARY OF THE INVENTION

The present invention relates to molded fiber products and manufacturing thereof.

It is an object of this invention to provide a molded fiber product manufacturing system that is operable to press a molded fiber product after the coating process to bolster its structural integrity while containing viscous contents and provide fiber-to-solution proportions to achieve desired structural properties of molded fiber products.

In one embodiment, the present invention includes a molded fiber product produced using a split mold device, including a threaded neck portion and a hollow body, wherein the molded fiber product comprises a natural fiber composition, wherein the split mold device is configured to deliver negative pressure to a cavity of the split mold device via a first chamber and a second chamber, wherein the molded pulp product is formed within the cavity, wherein the hollow body and the threaded neck portion are of varying wall thickness, such that the threaded neck portion is of a different thickness than the hollow body, wherein the threaded neck portion is unitary and integrally formed as part of the molded pulp product.

In another embodiment, the present invention includes a split mold device for molding products from a fiber pulp slurry, including a lower block including a lower mold connected to a lower vacuum block, the lower vacuum block including a first lower chamber and a second lower chamber, an upper block including an upper mold connected to an upper vacuum block, the upper vacuum block including a first upper chamber and a second upper chamber, a multi-way valve connected to a first suction line and a second suction line, wherein the lower block is connected to the upper block via at least one joint, wherein the joint is configured to reversibly join the lower mold and the upper mold, wherein the lower mold and the upper mold form a cavity when the lower block is joined to the upper block, wherein the cavity includes a first region and a second region, wherein the first suction line is configured to deliver negative pressure to the first lower chamber and the first upper chamber when the multi-way valve is in a first position, wherein the second suction line does not deliver negative pressure to the second lower chamber and the second upper chamber when the multi-way valve is in the first position, wherein the second suction line is configured to deliver negative pressure to the second lower chamber and the second upper chamber when the multi-way valve is in a second position, wherein the first suction line does not deliver negative pressure to the first lower chamber and the first upper chamber when the multi-way valve is in the second position, wherein the first suction line is configured to deliver negative pressure to the first region of the cavity and the second suction line is configured to deliver negative pressure to the second region of the cavity when the multi-way valve is in a third position, and wherein the upper mold and the lower mold form the entirety of the cavity, such that a molded pulp product formed using the split mold device is unitary and integrally formed using only the upper mold and lower mold to form the product.

In yet another embodiment, the present invention includes a method for manufacturing a molded fiber product, including joining an upper mold block to a lower mold block, wherein an upper mold of the upper mold block and a lower mold of the lower mold block form a cavity when the upper mold block is joined to the lower mold block, a first suction line applying negative pressure to a first region of the cavity and a second suction line applying negative pressure to a second region of the cavity, wherein the applied negative pressure is controlled via a multi-way valve, submerging at least a portion of the upper mold block and the lower mold block in a pulp slurry and applying negative pressure to the cavity, wherein the pulp slurry is vacuumed onto the cavity, forming a molded pulp product with varying wall thickness, wherein the molded pulp product comprises a natural fiber composition.

In yet another embodiment, the present invention includes a method for manufacturing a molded fiber product, including joining an upper mold block to a lower mold block to form a joined mold block, wherein a joint is configured to join and separate the upper mold block and the lower mold block, wherein a cavity is formed between the upper mold block and the lower mold block when the upper mold block is joined with the lower mold block, submerging the joined mold block in a pulp slurry, wherein the pulp slurry comprises a natural fiber composition, applying negative pressure to a first region of the cavity via a first suction line connected to a multi-way valve, wherein the pulp slurry is vacuumed onto the first region of the cavity, applying negative pressure to a second region of the cavity via a second suction line connected to the multi-way valve, wherein the pulp slurry is vacuumed onto the second region of the cavity, alternating the negative pressure applied to the cavity by adjusting the position of the multi-way valve, such that negative pressure is only applied to the first region of the cavity when the multi-way valve is in a first position or a second position, negative pressure is only applied to the second region of the cavity when the multi-way valve is in a second position, and negative pressure is not applied to the cavity when the multi-way valve is in a third position, forming a molded pulp product with varying wall thickness, wherein the molded pulp product comprises a natural fiber composition, pressing the molded pulp product within the cavity, drying the molded pulp product within the cavity, and separating the upper mold block from the lower mold block and removing the molded pulp product from the cavity.

These and other aspects of the present invention will become apparent to those skilled in the art after a reading of the following description of the preferred embodiment when considered with the drawings, as they support the claimed invention.

DETAILED DESCRIPTION

Figure 1:
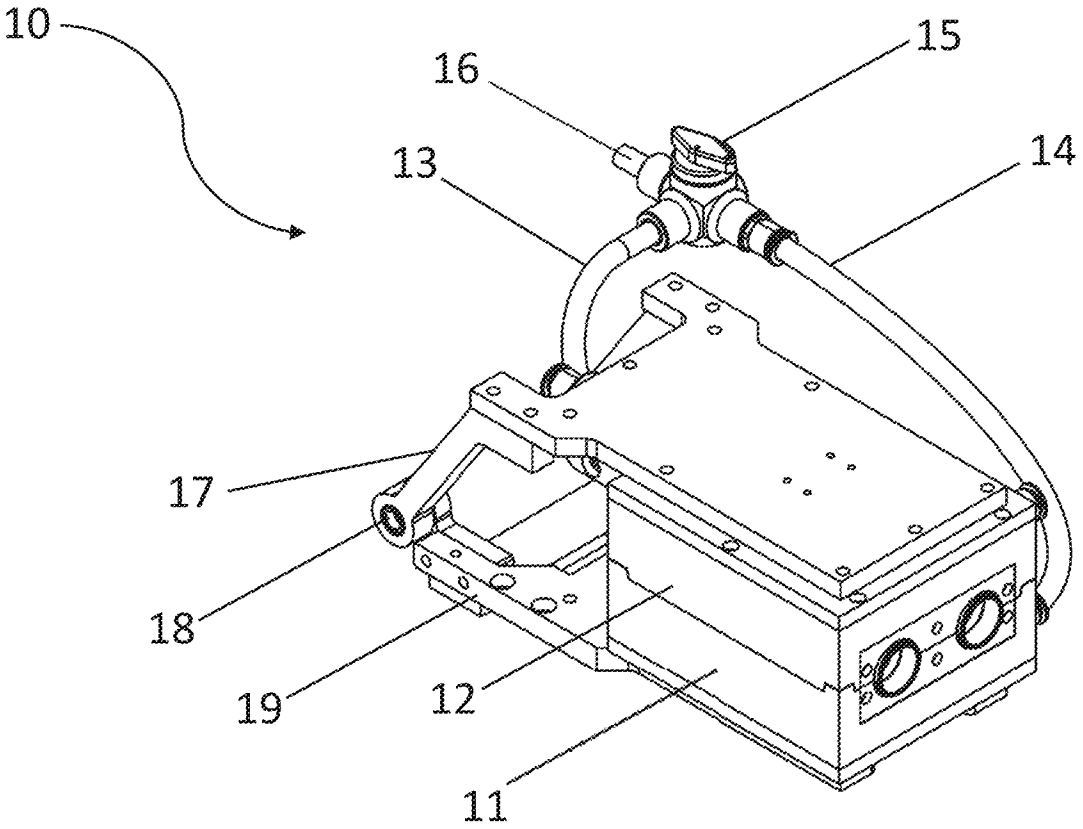
FIG. 1 illustrates a perspective side view of a fiber molding device according to one embodiment of the present invention.

The present invention is generally directed to methods and systems for producing three-dimensional biodegradable products molded from pulp fiber, wherein the biodegradable products are coated with a biodegradable wax to make the biodegradable product water resistant and prevent degradation of the molded fiber product. The molded fiber product, after being coated, is pressed a second time.

In one embodiment, the present invention includes a molded fiber product produced using a split mold device, including a threaded neck portion and a hollow body, wherein the molded fiber product comprises a natural fiber composition, wherein the split mold device is configured to deliver negative pressure to a cavity of the split mold device via a first chamber and a second chamber, wherein the molded pulp product is formed within the cavity, wherein the hollow body and the threaded neck portion are of varying wall thickness, such that the threaded neck portion is of a different thickness than the hollow body, wherein the threaded neck portion is unitary and integrally formed as part of the molded pulp product.

In another embodiment, the present invention includes a split mold device for molding products from a fiber pulp slurry, including a lower block including a lower mold connected to a lower vacuum block, the lower vacuum block including a first lower chamber and a second lower chamber, an upper block including an upper mold connected to an upper vacuum block, the upper vacuum block including a first upper chamber and a second upper chamber, a multi-way valve connected to a first suction line and a second suction line, wherein the lower block is connected to the upper block via at least one joint, wherein the joint is configured to reversibly join the lower mold and the upper mold, wherein the lower mold and the upper mold form a cavity when the lower block is joined to the upper block, wherein the cavity includes a first region and a second region, wherein the first suction line is configured to deliver negative pressure to the first lower chamber and the first upper chamber when the multi-way valve is in a first position, wherein the second suction line does not deliver negative pressure to the second lower chamber and the second upper chamber when the multi-way valve is in the first position, wherein the second suction line is configured to deliver negative pressure to the second lower chamber and the second upper chamber when the multi-way valve is in a second position, wherein the first suction line does not deliver negative pressure to the first lower chamber and the first upper chamber when the multi-way valve is in the second position, wherein the first suction line is configured to deliver negative pressure to the first region of the cavity and the second suction line is configured to deliver negative pressure to the second region of the cavity when the multi-way valve is in a third position, and wherein the upper mold and the lower mold form the entirety of the cavity, such that a molded pulp product formed using the split mold device is unitary and integrally formed using only the upper mold and lower mold to form the product.

In yet another embodiment, the present invention includes a method for manufacturing a molded fiber product, including joining an upper mold block to a lower mold block, wherein an upper mold of the upper mold block and a lower mold of the lower mold block form a cavity when the upper mold block is joined to the lower mold block, a first suction line applying negative pressure to a first region of the cavity and a second suction line applying negative pressure to a second region of the cavity, wherein the applied negative pressure is controlled via a multi-way valve, submerging at least a portion of the upper mold block and the lower mold block in a pulp slurry and applying negative pressure to the cavity, wherein the pulp slurry is vacuumed onto the cavity, forming a molded pulp product with varying wall thickness, wherein the molded pulp product comprises a natural fiber composition.

In yet another embodiment, the present invention includes a method for manufacturing a molded fiber product, including joining an upper mold block to a lower mold block to form a joined mold block, wherein a joint is configured to join and separate the upper mold block and the lower mold block, wherein a cavity is formed between the upper mold block and the lower mold block when the upper mold block is joined with the lower mold block, submerging the joined mold block in a pulp slurry, wherein the pulp slurry comprises a natural fiber composition, applying negative pressure to a first region of the cavity via a first suction line connected to a multi-way valve, wherein the pulp slurry is vacuumed onto the first region of the cavity, applying negative pressure to a second region of the cavity via a second suction line connected to the multi-way valve, wherein the pulp slurry is vacuumed onto the second region of the cavity, alternating the negative pressure applied to the cavity by adjusting the position of the multi-way valve, such that negative pressure is only applied to the first region of the cavity when the multi-way valve is in a first position or a second position, negative pressure is only applied to the second region of the cavity when the multi-way valve is in a second position, and negative pressure is not applied to the cavity when the multi-way valve is in a third position, forming a molded pulp product with varying wall thickness, wherein the molded pulp product comprises a natural fiber composition, pressing the molded pulp product within the cavity, drying the molded pulp product within the cavity, and separating the upper mold block from the lower mold block and removing the molded pulp product from the cavity.

None of the prior art discloses pressing the material a second time after coating the initially pressed material to strengthen the molded fiber product, wherein the coating used for the molded fiber product consists of a variety of waxes, oils, and mixtures thereof. Additionally, none of the prior art discloses changing the composition of the pulp water ratio to change the properties of the pulp in the manufacturing process to produce a product with specific desired properties.

Over the course of humanity's reign on Earth, our contribution to pollution has increased rapidly even in just the past century. Much of this pollution is waste or trash that cannot break down, but rather stays as waste forever. Many of the mass-produced products used by people use plastic or other nonbiodegradable products. The development of plastics, while a groundbreaking discovery in materials engineering, has brought about a growing environmental catastrophe. Because plastics and similar materials are not biodegradable, an excessive number of landfills are needed to just contain this waste. However, landfills do not completely prevent waste from leeching into the soil and polluting the environment. In fact, the collection and high concentration of waste in a specified area exacerbates the environmental hazards. Further, landfills are known to produce carbon dioxide, methane, ammonia, and sulfides. These gases are released into the atmosphere and cause a laundry list of environmental problems, including greenhouse gases, ozone layer destruction, and smog. Landfills, because of their emissions, contribute to the melting of the polar ice caps, and raising the sea level. Rising sea levels result in the erosion of beaches and loss of many marshes and wetlands. Saltwater intrusion into estuaries is also an issue, harming the wildlife that requires these crucial estuaries. Because this nonbiodegradable waste never breaks down, there only exists a growing need for more of these landfills. More landfills mean more of the same problems. This becomes a vicious cycle of a harmful problem requiring an equal if not greater harmful solution.

Not only are landfills a problem, but also much of the waste in the world ends up in our oceans. This pollution kills marine life, destroys ecosystems, and further exacerbates the ongoing climate crisis. Animals affected by plastic pollution suffer from ingestion of plastic, suffocation, and entanglement. Coral in the ocean that encounters plastic waste has increased chances of contracting diseases, thus greatly affecting the surrounding ecosystem. These effects are frequently fatal to wildlife. Aside from the destruction of the ecosystem, marine pollution poses a substantial risk to humans as well. Animals in areas of high marine pollution collect plastics, particularly microplastics, in their body.

Microplastics are microscopic plastic particulates which are capable of entering living organisms. The known and growing problem posed by microplastics is that once they are ingested, either by humans or other animals, they are never broken down. When humans consume animal products, such as meat, containing these microplastics, it can lead to long-term health conditions such as cancer and birth defects. Thus, the continued manufacturing and use of plastic products contributes not only to the climate crises, but also negatively impacts global public health. In order to encourage a change, the biodegradable manufacturing industry must be improved, such that biodegradable products can rival traditional, plastic-based products in their function, durability, cost, and ease of manufacturing.

There exist methods of producing environmentally friendly, biodegradable products in an effort to reduce plastic consumption. These methods use fiber pulp to form biodegradable products. One process known in the art involves the use of a vacuum attached to a mesh mold of the desired product. The vacuum is used to create negative pressure, which causes the pulp slurry to conform to the mesh layer according to the desired thickness of the molded fiber product. The molded form is then transferred to a separate mold to press the molded fiber into the proper shape. Another process applies a compressive force to a material applied to a mold, resulting in the formation of a molded product. Some products are selectively coated to prevent the breakdown of the product if configured for use in contact with liquids or other viscous contents by spraying the coating onto the product or submerging the product in a coating material. However, extended exposure to moisture causes many pulp products formed by existing methods to degrade. As a result, plastic products, and particularly plastic products for distribution of liquids, remain the preferred industry packaging type, as plastic is currently more efficient at maintaining integrity for extended periods of exposure to liquid than the pulp products of the prior art. Additionally, some prior art attempts to combine plastic ingredients and components with biodegradable materials in order to create reinforced fiber products, such as products for liquids. However, the use of incorporated plastic, such as plastic threaded necks and plastic fiber reinforcement, prevent these products from fully degrading.

Currently there exists an unmet need for fully biodegradable, pulp-based products which are capable of maintaining integrity (i.e., not degrading) during extended exposure to liquid or moisture and a process for creating such products. Further, there is an un-met need for a biodegradable, pulp-based product that does not include plastic, bioplastic, or similar non-degradable components or ingredients. Further still, there is an unmet need for a fully biodegradable, pulp-based product which includes a simultaneously formed, biodegradable, threaded neck for attachment of a threaded cap for easy storage, transportation, and consumption of liquid stored within the product. The present invention has provided a process for producing such a product, succeeding where others have failed.

Referring now to the drawings in general, the illustrations are for the purpose of describing one or more preferred embodiments of the invention and are not intended to limit the invention thereto.

In one embodiment, the present invention includes submerging a fiber molding device into a pulp slurry of a specified material-to-water ratio, wherein a vacuum system is used within the fiber molding device to vacuum pulp slurry to a porous molding surface within the fiber molding device. The porous molding surface is shaped for the desired product shape, and water passes through the porous molding surface, through suction lines that create the vacuums. The material in the pulp slurry is condensed against the surface of the porous molding surface uniformly and allows for selective thickness of sections of the porous molding surface by separated chambers. Once forming is complete, the molded fiber product is optionally pressed and coated for use in a variety of cases including, but not limited to, food, cosmetics, pharmaceuticals, and electronics.

Fiber Molding Process

FIG. 1 illustrates a suction mold device 10 for creating molded fiber products from a pulp slurry according to one embodiment of the present invention. A suction mold device 10 includes a pump line 16 connected to a three-way valve 15. The three-way valve 15 is connected to a major suction line 13 and a minor suction line 14. As used herein, the term "major" refers to portions of the invention that relate to the larger chamber in the suction mold device 10. As used herein, the term "minor" refers to portions of the invention that relate to the smaller chamber in the suction mold device 10. The major suction line 13 is connected to the major chambers 31 and 30 while the minor suction line 14 is connected to the minor chambers 33 and 32. The major suction line 13 and minor suction line 14 are operable to vacuum fluid from their respective chambers by negatively pressurizing the chamber. The major suction line 13 and minor suction line 14 are connected to a lower suction mold 11 and an upper suction mold 12. The lower suction mold 11 and upper suction mold 12 are connected via restraining elements 17 and 19. These restraining elements 17 and 19 are connected by a joint 18. The joint 18 is moveable such that the lower suction mold 11 and upper suction mold 12 of the suction mold device 10 are separable from one another.

In one embodiment, the lower suction mold and upper suction mold are kept closed by means of magnets, hydraulic presses, hydraulic pistons, pneumatic pistons, electric drives, latches, screws, and/or pressurized closing of the molds. One of ordinary skill in the art will appreciate that the present invention is adaptable to utilize other suitable closing mechanisms known in the art.

In one embodiment, the three-way valve is a gear knob, allowing the three-way valve to be switched manually. In another embodiment, the three-way valve is controllable automatically by a user device, computer, sensor, or other system capable of automatically controlling the position of the three-way valve. One of ordinary skill in the art will appreciate that the present invention is operable to utilize any suitable automatic or manual three-way valves to control the airflow in the suction lines.

In one embodiment, the pulp slurry disclosed herein is a mixture of fiber and fluid (e.g., air, water). The fiber is operable to be mixed with any fluid known in the art to create a pulp slurry mix. In one embodiment, the pulp mixture is a mixture of fiber and water. In one embodiment, the pulp mixture is a mixture of fiber and air. In this embodiment, the fibers are deposited from a fluidized bed to the porous walls of the suction mold device. This eliminates the need for a dewatering and drying process.

In one embodiment, the fiber used in the pulp slurry is paper pulp, such as northern bleached kraft pulp (NBKP), lead bleached kraft pulp (LBKP), and/or non-wood pulp, such as bamboo, straw, hemp, jute, sweetgrass, and flax. One of ordinary skill in the art will appreciate that the present invention is operable to utilize any type of pulp fiber material known in the art. In one embodiment, the fibers of the pulp slurry are not recycled fibers. In one embodiment, the fibers of the pulp slurry are virgin fibers. In one embodiment, the fiber quality is a food grade fiber quality according to the Food and Drug Administration (FDA), the European Food Safety Authority (EFSA), or any similar governing body associated with regulating food safety protocols. In one embodiment, the pulp fibers have a length of about 0.1 to 10.00 mm and a thickness of about 0.01 to 0.05 mm. One of ordinary skill in the art will appreciate that any dimension of fibers known in the art are usable in the present invention. In one embodiment, the pulp-water slurry contains 1% by weight of pulp fiber.

In one embodiment, the pulp-water slurry contains inorganic substances including, but not limited to, talc, kaolinite, inorganic fibers such as glass fiber and carbon fiber, synthetic resin powder or fiber, and/or polysaccharides. The amount of these components in the slurry ranges from 1% to 70% by weight based on the total amount of the pulp fibers and these components. In one embodiment, the pulp slurry of the present invention does not include any additives to the pulp slurry.

In one embodiment of the present invention, the distribution of fibrous material in the pulp slurry is significantly homogeneous. In this way, the same volume flow at different points of a section of the wall results in the same amount of fibrous material being deposited to form a fibrous material layer. Similarly, the density of the deposited fibrous material layer is essentially the same in all sections of the fibrous material layer where the same pressure is applied.

Figure 2:
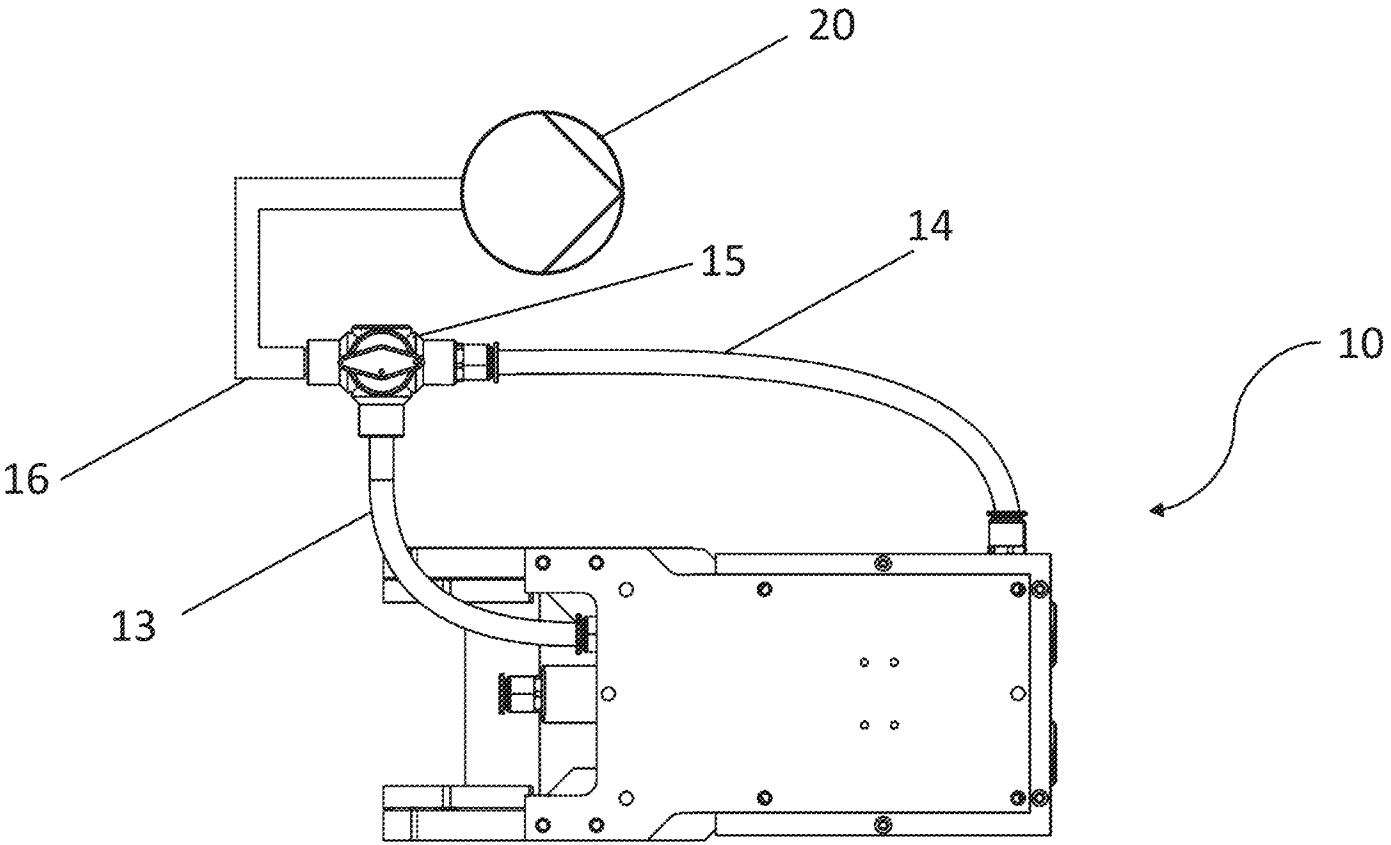
FIG. 2 illustrates an orthogonal top view of a fiber molding device according to one embodiment of the present invention.

FIG. 2 illustrates a top view of the suction mold device according to one embodiment of the present invention. The three-way valve 15 is connected to a pump 20. The pump 20, when activated, uses the major suction line 13 and minor suction line 14 to create negative pressure in their respective zones. This negative pressure creates a vacuum to cause these negatively pressured areas to pull from positively pressured zones within the suction mold device 10. In one embodiment, the three-way valve is automatically controlled to shut off connection from the pump 20 to at least one suction line 13 and 14.

Figure 3A:
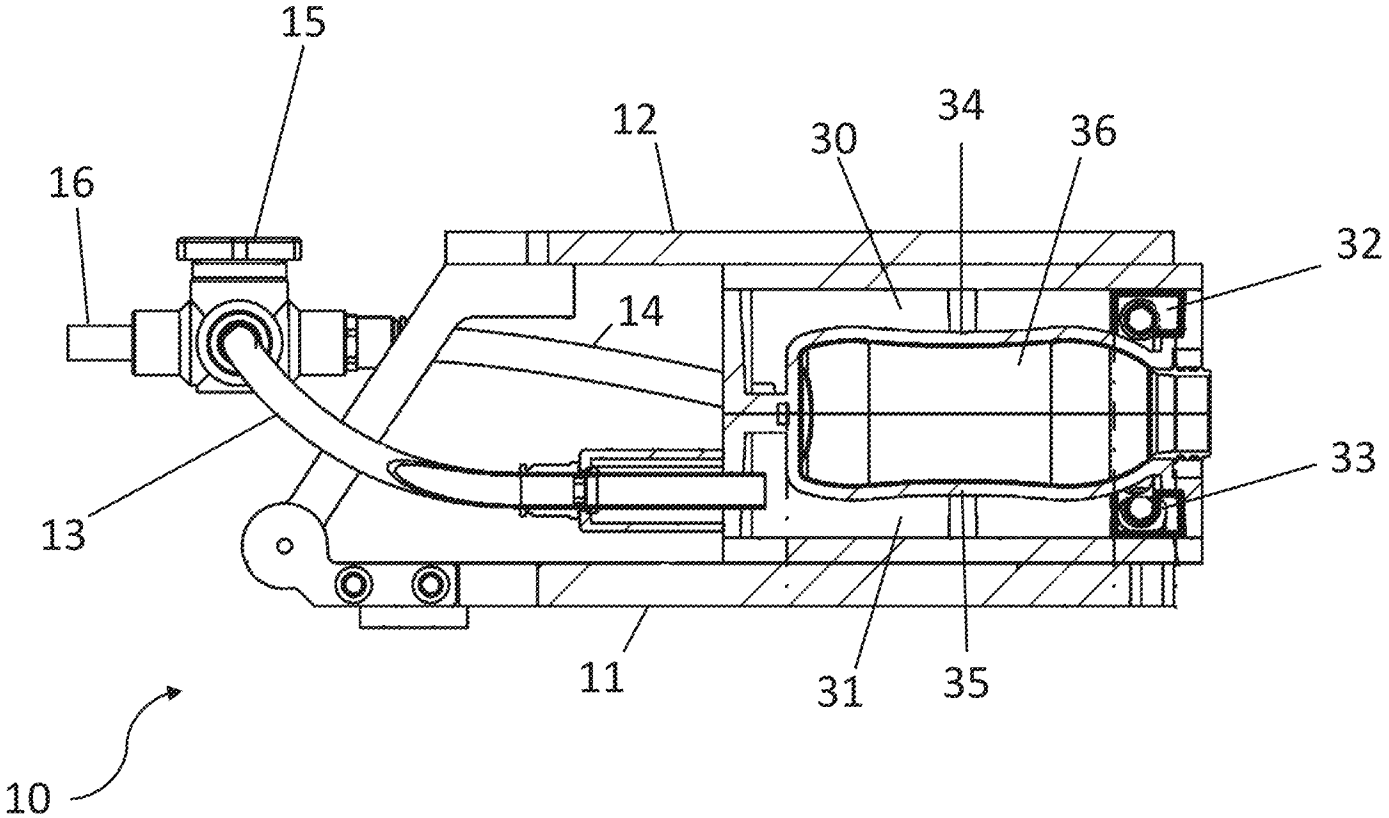
FIG. 3A illustrates a transparent orthogonal side view of a fiber molding device according to one embodiment of the present invention.
Figure 3B:
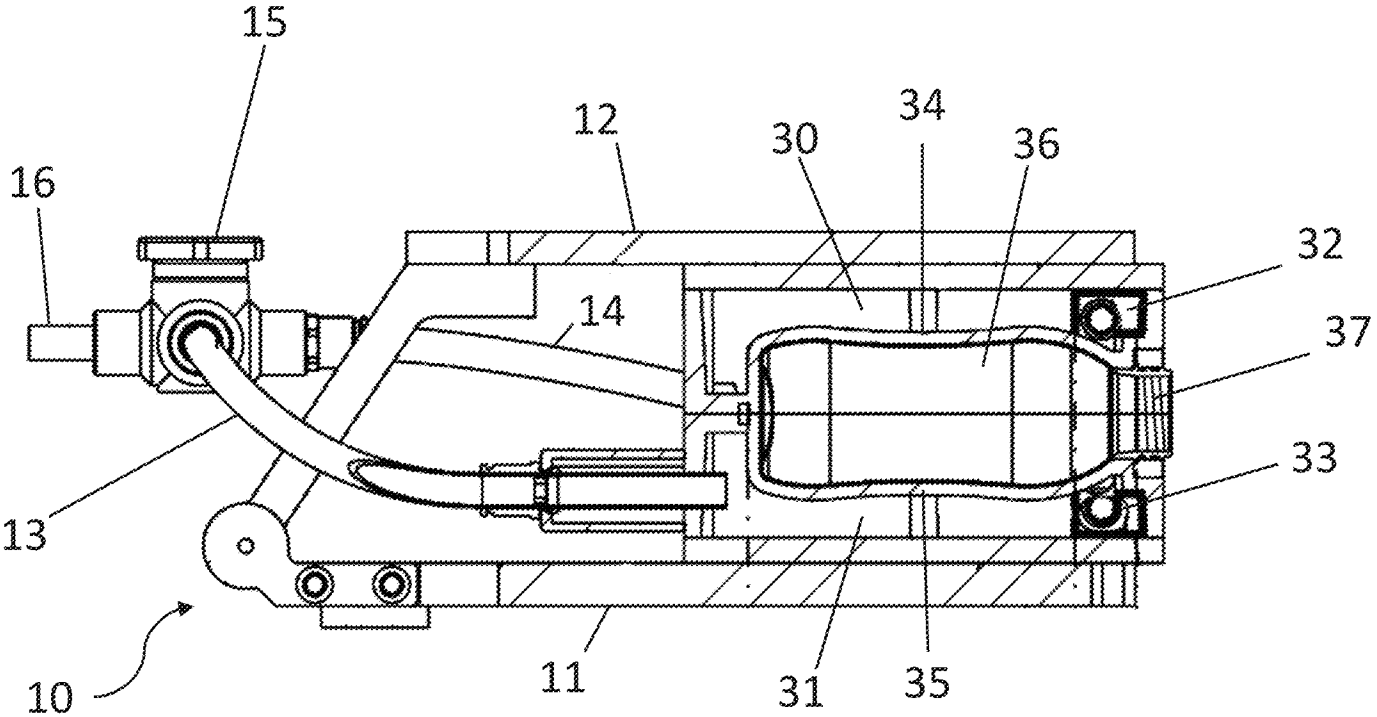
FIG. 3B illustrates a transparent orthogonal side view of a fiber molding device with a threaded neck piece according to one embodiment of the present invention.

FIGS. 3A and 3B illustrate a transparent side view of the suction mold device 10 according to one embodiment of the present invention. The lower suction mold 11 and upper suction mold 12 include hollow sections that make up the major chambers 30, 31, as well as minor chambers 32, 33. The major chambers 30, 31 are separated from the minor chambers 32, 33 by a partition. This partition enables the major chambers 30, 31 and minor chambers 32, 33 to have their own respective independently controlled pressures. The major suction line 13 is connected to the major chambers 30, 31, and minor suction line 14 is connected to the minor chambers 32, 33. The lower suction mold 11 and upper suction mold 12 further contain porous walls 34, 35 for use in molding the pulp to the shape of the suction mold. The porous walls 34 and 35 permit fluid of the pulp slurry to exit the cavity into the chambers while preventing the solid material of the pulp slurry from exiting the cavity. When suction mold device 10 is closed, such that the upper suction mold 12 and lower suction mold 11 come together, a cavity 36 is formed according to the desired shape/form of the pulp product to be created using the suction mold device 10.

The present invention is modifiable to include a variety of cavity shapes and is not limited by the illustration of FIGS. 3A and 3B. Any conceivable product shape and size is operable to be produced by modifying the upper suction mold and lower suction mold to the desired shape and size of the molded fiber product.

In one embodiment, when the suction mold device is closed, the major suction line connects to both major chambers. In one embodiment, when the suction mold device is closed, the minor suction line connects to both minor chambers. In one embodiment, the shape of the cavity is in the shape of a symmetrical product. Examples of symmetrical products include but are not limited to bowls, cups, bottles including bottles with handles and bottles with threaded necks, food trays, coffee pods, and boxes. In one embodiment, the shape of the cavity is in the shape of an asymmetrical product (e.g., a customized mold wherein the upper suction mold and the lower suction mold are not identical).

In one embodiment, there is only one chamber in the lower suction mold and upper suction mold, such that there is only need for a single major suction line. In one embodiment, the airflow in the suction line is controlled by a three-way valve, a two-way valve, and/or a pump. In another embodiment, three, four, five, or more suction lines are used in the suction mold device to permit for more independently pressured sections in the device. One of ordinary skill in the art will appreciate that the present invention is modifiable to include any number of suction lines and chambers.

In one embodiment, the suction mold device of the resent invention is configured to be submerged in the pulp slurry mixture. In one embodiment, the suction mold device is fully submerged in the pulp slurry mixture. In one embodiment, the suction mold device is partially submerged in the pulp slurry mixture. Upon being submerged, either fully or partially, into the pulp slurry, the cavity is filled with the pulp slurry through one or more openings in the cavity. In one embodiment, the pump is activated while the suction mold device is submerged to negatively pressurize the major chambers and minor chambers. During this negative pressurization, the fluid (e.g. water) of the pulp slurry is sucked through the porous walls and into the chambers and subsequently through the suction lines. While the fluid (e.g., water) in the pulp slurry is sucked through the porous walls, the solid material (e.g., the fibers) in the pulp slurry is suctioned against the porous walls, conforming to the shape of the cavity. In one embodiment, the pump uniformly pressurizes the major chambers and minor chambers, such that the solid pulp material is evenly distributed across the entirety of the porous walls. In one embodiment, the pump pressurizes the major chambers and minor chambers with different lengths of time and/or units of pressure, such that the solid pulp material is not evenly distributed across the entirety of the porous walls.

In one embodiment, the present invention does not inject the pulp slurry of the present invention into the cavity of the suction mold device. Injection of the pulp slurry is operable to cause irregular wall thickness due to uneven application of the slurry to the mold, particular in molds with complex geometry (e.g., molds which include several angles, intricate details, and varying apertures). The submersion of the mold in the pulp slurry allows for the even distribution of the slurry to the mold, producing regular wall thickness even in molds with complex geometries. No significant forces act on the tools used in the submersion molding process, where the injection method requires the pressurized application of pulp slurry to the mold, and, further, compression molding necessitates the application of pressure to the mold. In one embodiment, the present invention does not use a pressurized pulp slurry application method to apply the pulp slurry to the mold.

In one embodiment, the present invention does not use a compression molding method to press the pulp slurry into an initial shape. Pulp compression molding uses pulp with a lower water content compared to the pulp utilized in the submersion method, as the higher water content of the later method decreases the thickness of the pulp and allows for faster pulp intake when the mold is submerged. The decreased water content of the pulp utilized by the compression method results in the pulp being thicker than the watery pulp of the submersion method. After the thick pulp is applied to the mold, positive pressure (i.e., pressure) must be applied to let the pulp creep into all contours of the mold. Thus, the molding surface and the mold utilized in the compression method must withstand a significant amount of pressure. As a result, the molding equipment for compression molding tends to be more costly than that of the submersion method. In one embodiment, the molding surfaces of the mold of the present invention are operable to be made of a material with appropriate support (e.g., a metal seize) capable of withstanding the pressure applied during the compression method of molding (e.g., between about 50 to about 100 tons of compressive force).

In one embodiment, the present invention does not include a preparation step preceding the negative pressurization to regulate wall thickness of the molded fiber product (e.g., the application of a cellophane tape to locally reduce the volume flow). The pre-treatment of the molds of the prior art is required for producing consistent products with uniform wall thickness. However, these preparation steps are time intensive and prohibit rapid production of molded products, thus disincentivizing the use of such products in comparison to rapidly available but environmentally detrimental alternatives, such as plastic. The present invention does not require a step to prepare the suction mold device in order to regulate the wall thickness of molded fiber products, for reasons disclosed herein with respect to negative pressurization and the homogeneity of the pulp slurry. By automatically submitting individual regions of the mold to different suction times, the wall thickness may be varied without installing physical suction barriers.

In one embodiment, the thickness of the molded fiber product is dependent on the length of time negative pressure is applied to the chambers of the suction mold device. One of ordinary skill in the art will appreciate that a long suction time creates a thick-walled section of the molded fiber product while a short suction period creates a thin-walled section of the molded fiber product. Longer exposure to negative pressure creates more accumulation of solid pulp material on the porous walls. The longer negative pressure is applied to a section of the molded fiber product, the thicker the walls of that section become. In one embodiment, the suction mold device is operable to apply negative pressure in the chambers at varying lengths of time, in order to achieve a desired thickness of the molded fiber product. In one embodiment, continuous negative pressure is applied to the suction mold device by a pump, and a valve system as disclosed herein is used to distribute the negative pressure to one or more sections of the suction mold device. In one embodiment, the pump continuously sucks fluid from the pulp slurry, consequently more pulp slurry is sucked into the cavity causing an overall increase in the thickness of the molded fiber. In one embodiment, the suction mold device is operable to apply negative pressure in the chambers at varying pressures, in order to achieve a desired thickness of the molded fiber product. One of ordinary skill in the art will appreciate that the application of decreased pressure reduces the amount of pulp slurry which accumulates on the wall of the suction mold device in comparison to areas of higher pressure.

In one embodiment, the three-way valve is used to deactivate the pressurization of one or more chambers while continuing to negatively pressurize one or more other chambers. For example, in one embodiment, the three-way valve is used to deactivate the pressurization of the major chambers, while continuing to negatively pressurize the minor chambers. The minor chambers continue pulling pulp slurry to their portion of the porous walls while the major chambers do not, resulting in the increased accumulation of fiber material in the portion of the fiber-molded product connected to the minor chambers compared to the major chambers. This allows the upper portion of the cavity (e.g., the neck of a bottle) to become thicker with pulp, thus strengthening this specific portion of the molded fiber product compared to the areas where the major vacuum chambers pull the pulp to the porous walls. In this way, the molded fiber product formed from the pulp slurry is more stable in comparison to molded products formed using uniform pressurization. For example, the threaded neck of a bottle formed from the minor chambers of the suction mold device of the present invention is stably formed to withstand increased mechanical stress in comparison to prior art which does not increase the thickness of the neck uniformly through the use of negative pressurization. While some prior art may contemplate increasing the thickness of a neck region of a molded bottle, these machines are configured to fold a portion of the molded product after complete dehydration and formation of the product without increasing the thickness integrally and uniformly during a negative pressurization step of the molding process (i.e., affecting the amount of fibrous material which is deposited on the chamber wall). However, the molded fiber product of the present invention is not folded to create varying wall thickness. Rather, the variation in thickness results from the timing of negative pressurization disclosed herein.

Further, decreased pressurization times are advantageous for forming products with thin walls. Thin-walled products are useful for reducing the amount of pulp material required to form molded products. Additionally, thin-walled products reduce overall product weight, decreasing the cost of shipping and transportation of the products, as well as making each individual product more convenient for consumer use.

In one embodiment, upon completion of the molding of the product from a first pulp slurry composition, the suction mold device is placed in a second pulp slurry and the negative pressurization process is repeated. In one embodiment, the second pulp slurry includes a different composition of fiber, inorganic compounds, and/or fluid. In one embodiment, the second pulp slurry is comprised of a low absorption fibers to create a moisture resistant barrier of fibrous material.

In one embodiment, upon completion of the molding of the product, the suction mold device opens using the joint to separate the lower suction mold and upper suction mold from one another, allowing the molded fiber product to be removed from the cavity. In one embodiment, once the molded fiber product is removed from the suction mold device, the product is pressed and/or coated. In one embodiment, the product is neither pressed nor coated after formation, and is complete upon removal from the suction mold device. One of ordinary skill in the art will appreciate that the desired wall thickness of the molded fiber product is achieved during the negative pressurization of the pulp slurry and thus, no downstream process step for pressing the molded fiber article is required to regulate wall thickness.

In one embodiment, upon completion of the molding of the product, the suction mold device then undergoes drying without removal of the molded fiber product from the device. In this way, the fiber mold device is operable to be made comparatively thinner than molded articles of the prior art, as the molded fiber product of the present invention does not need to be formed with a thickness suitable for handling when not fully dried. That is to say, a pulp molded fiber article which has not been dried is delicate and prone to ripping. The prior art requires pressure dehydration within the mold or removal of the molded article before drying can occur. This removal process may damage the molded fiber product and therefore render the product useless. Thus, the present invention advantageously allows for the drying of the three-dimensional molded article within the suction mold device. In one embodiment, the drying of the molded fiber product within the suction mold device does not include pressure dehydration. In one embodiment, the drying of the molded fiber product within the suction mold device includes temperature-based dehydration, wherein heated and pressurized air is pumped into the mold. The air stream penetrates the fiber layer, drying the fibers as the steam is drawn through the porous walls of the suction mold and removed through the suction lines.

In one embodiment, the cavity is shaped according to the desired product to be made, including, but not limited to, cups, bowls, trays, cutlery, household items (e.g., razor handles). One of ordinary skill in the art will appreciate that the location of the major and minor areas disclosed herein will vary depending on the shape and intended use of the desired product. Packages, food containers, razor handles, and knives, forks and other cutlery items all require different regions of the product to be reinforced while other regions should be thin. Thus, the major areas and minor areas of the mold for each fiber product will vary to produce the desired shape and thick and thin regions as disclosed herein.

In one embodiment, the resulting molded product includes a biodegradable threaded neck. In one embodiment, the suction mold device includes a threaded shape in the porous walls within the minor chamber of the present invention. In this way, the suction mold device creates a threaded neck on the molded fiber product such that the neck is integrated into the molded fiber product of the present invention. This enables the threaded neck section to be integrally and uniformly formed simultaneously with the body of the molded fiber product, thereby creating one entire product with a threaded sealing portion. In one embodiment, the present invention does not include a neck piece or similar insert. In one embodiment, the present invention does not include a plastic threaded neck. In one embodiment, the threaded fiber neck is not folded. In one embodiment, the threaded fiber neck is not formed prior to or subsequentially to the body of the molded fiber product.

As disclosed herein, the increased duration of negative pressurization of the minor chamber allows for the formation of thicker walls formed in the minor chamber in comparison to the thin-walled major chamber. This is particularly advantageous for the formation of a molded fiber bottle with a threaded top, as the molded threads of the threaded shape must be of a sufficient thickness to withstand torsional force applied by a threaded cap. Further, the integral formation of the threaded neck portion of the present invention is enabled by the simultaneous formation of both thick and thin walls of the molded fiber product of the present invention. One of ordinary skill in the art will appreciate that varying the thickness of molded fiber walls after negative pressurization would not result in the same even distribution and reinforcement that is provided by the simultaneous formation of the present invention.

FIG. 3B illustrates a threaded mold 37 within the suction mold device 10 according to one embodiment of the present invention. The threaded mold 37 is located between the minor chambers of the device 10, at the front of the cavity 36. In this way, the negative pressurization of the minor chambers creates vacuum suction for only the threaded mold portion of the porous walls.

The threaded mold is significantly porous to allow for the removal of liquid from the pulp slurry as the minor chamber is negatively pressurized. In one embodiment, the porous walls of the threaded mold are comprised of the same material as the porous walls of the major chamber. In one embodiment, the threaded mold comprises aluminum tooling. In one embodiment, the threaded mold is created using additive deposition modeling (i.e., 3D printed porous mold walls). In one embodiment, the porous walls of the suction mold device are 3D printed. In one embodiment, the 3D printing processes, systems, and devices used in the present application include those described in U.S. application Ser. No. 18/431,451, filed Feb. 2, 2024, which is incorporated herein by reference in its entirety.

Figure 4:
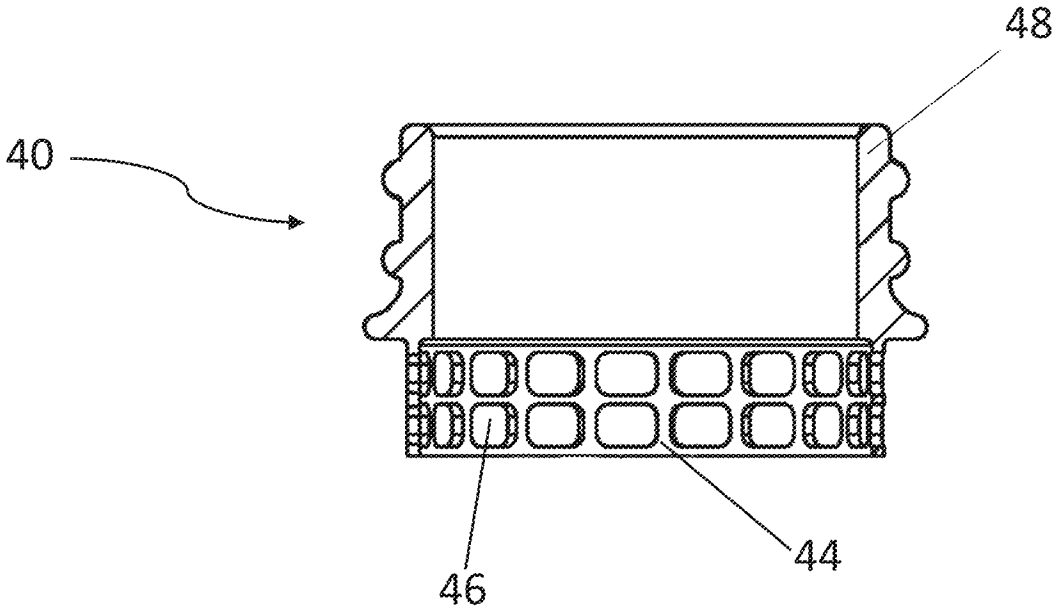
FIG. 4 illustrates a transparent orthogonal front view of a neck piece for a molded fiber product according to one embodiment of the present invention.

In one embodiment, the threaded neck is formed and/or reinforced by a biodegradable threaded fiber neck piece which is incorporated into the biodegradable product. FIG. 4 illustrates a threaded neck piece according to one embodiment of the present invention. The threaded fiber neck piece 40 contains a lattice section 44 including porous holes 46 and a threaded section 48. In one embodiment, the threaded neck piece is placed in the lower suction mold 11 prior to sealing the suction mold device and negative pressurization. Upon sealing the suction mold device, the threaded neck piece is situated between the minor chambers of the suction mold device.

In one embodiment, while the minor chambers are sucking pulp into their respective porous walls, the porous holes of the lattice section of the neck piece are filled with pulp material. The pulp material surrounds the lattice of the neck piece during negative pressurization, the fibrous material conforming around the surfaces of the lattice. The porous holes allow the fibrous material of the pulp slurry to enter the interior of the lattice section and overlay the fibers of the fibrous material that do not enter through the porous holes. The resulting fiber material is a fibrous matrix that weaves into the lattice section of the threaded neck piece. In one embodiment, the threaded section of the threaded neck piece is not covered by the pulp slurry during negative pressurization and therefore is not covered by a fibrous matrix upon completion of the molding process.

The thickened neck portion of the molded fiber product of the present invention advantageously allows for pouring liquids from the product without degrading the neck of the product or using a plastic component for reinforcement. Further, the threaded neck of the product allows for the attachment of a replaceable cap, such that the cap is screwed onto the threaded neck of the product, removed to access the liquid contents, and replaced to preserve the remaining contents. In this way, the product of the present invention is fully biodegradable while providing a product that is competitive to plastic alternatives, wherein a major factor is the ability to attach and remove a lid or cap from the product.

In one embodiment, the threaded neck piece is comprised of the same material as the pulp slurry. In one embodiment, the threaded neck piece is comprised of a condensed fibrous matrix. In one embodiment, the threaded neck piece is not comprised of recycled polymers. In one embodiment, the threaded neck piece is comprised of virgin polymers. In one embodiment, the threaded fiber neck piece is prefabricated from a biodegradable material such as a biodegradable thermoplastic, natural fiber. One of ordinary skill in the art will appreciate that the threaded fiber neck piece is operable to be created using a variety of biodegradable materials. Examples of materials operable to be used to create the threaded fiber neck piece include but are not limited to; biodegradable thermoplastics such as thermoplastic starch-based plastics (TPS), polyhydroxyalkanoates (PHA), polylactic acid (PLA), polybutylene succinate (PBS), or polycaprolactone (PCL); a biodegradable thermoplastic resin such as biobased polyethylene (PE), biobased polyethylene terephthalate (PET), biobased technical performance polymers (e.g., numerous polyamides (PA), or partially biobased polyurethanes (PUR); and natural fibers derived from plants such as hemp, flax, jute, wood, lignocellulosic plant fibers, baste plants, bamboo, or sweetgrass. Further, one of ordinary skill in the art will appreciate that, while the neck piece is operable to be formed from nonbiodegradable materials, the use of such materials will impact the degradation of the bottle of the present invention. In one embodiment, the threaded neck piece is that connection element disclosed in WIPO Pub. No. 2022/258707 and WIPO Pub. No. WO 2022/258697, each of which is incorporated herein by reference in its entirety. In one embodiment, the threaded neck piece is comprised of a thermoplastic material such as that disclosed in WIPO Pub. No. 2022/253731, incorporated herein by reference in its entirety.

Figure 5:
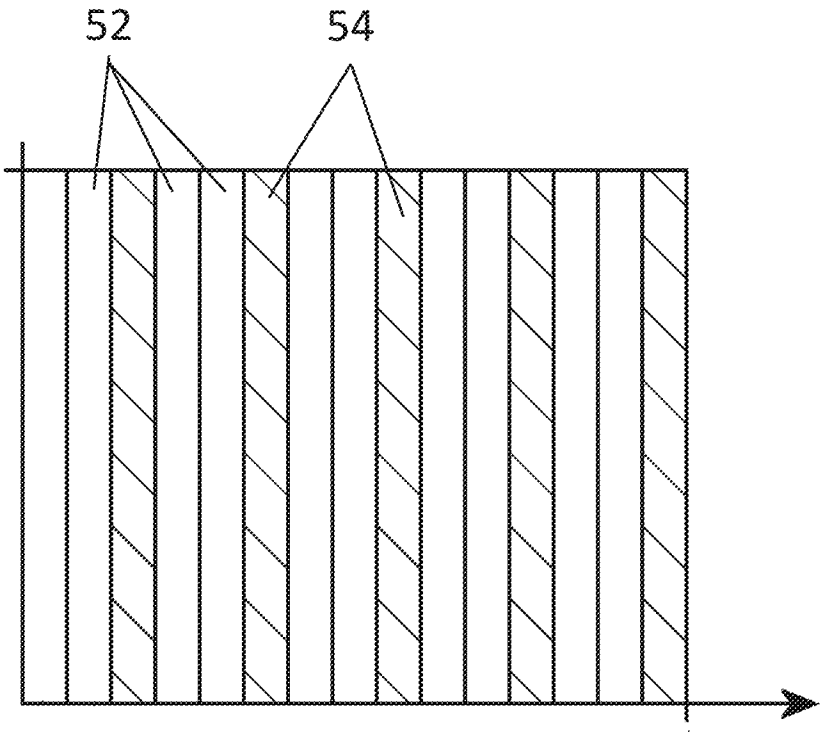
FIG. 5 illustrates a bar graph of time intervals according to one embodiment of the present invention.

FIG. 5 illustrates circuit states over time of the three-way valve during the molding process according to one embodiment of the present invention. The circuit states illustrate time intervals in which the major chambers and minor chambers are pressurized, and where only the minor chambers are pressurized. Synchronous intervals 52 indicate when all chambers are pressurized, and asynchronous intervals 54 indicate when only the minor chambers are pressurized.

During each synchronous interval, both the major suction line leading to the major chambers and the minor suction line leading to the minor chambers are fluidly connected to the pump. In this way, there is negative pressure in all chambers and pulp material is sucked in throughout the entirety of the porous walls, creating an even thickness during this interval. In the third interval, which is shown as an asynchronous interval, only the minor suction line is connected to the pump. The major suction line is shut off by the three-way valve. Thus, in an asynchronous interval, pulp material is sucked in only through the minor chambers and the pulp material is deposited at the front of the cavity where minor chambers create negative pressure, creating an uneven thickness during this interval. Each asynchronous interval provides a pause for the suction process in the area of the major chambers, while in the area of the minor chambers is continuously aspirated. The first three intervals are followed by two synchronous intervals, then an asynchronous interval. In this way, pulp material is continuously vacuumed in through the minor chambers during the negative pressurization period. Pulp material is vacuumed in though the major chambers for only ⅔ of the overall duration of the negative pressurization step.

In one embodiment, the negative pressurization of the pulp slurry is initiated and/or stopped at the same time. Thus, the suction times for the major and minor chambers, or any chambers with differing thickness, overlap at least partially. The different sections of the fibrous layer are therefore not formed successively, but simultaneously, at least in part. The sections are therefore stably connected to one another. Further, this creates a process that is faster in comparison to molded fiber formation processes of the prior art, as the interval for forming the thickest wall of the product is used to determine the duration of the negative pressurization step. Intermittent intervals occur wherein suction is ceased for the chambers corresponding to the thin-walled sections. Thus, sections of differing thickness are operable to be formed simultaneously.

In one embodiment, the three-way valve is operated automatically via wireless remote connection in order to automate control of the time intervals of the negative pressurization step. In one embodiment, this is accomplished using an electric actuator. In one embodiment, this is accomplished using a pneumatic actuator. In one embodiment, this is accomplished using a hydraulic actuator. The actuator is in network communication with a control device and is configured to receive a transmission from the control device in order to activate the valve and change (i.e., cut off) the negative pressure applied to the suction mold device of the present invention.

One of ordinary skill in the art will appreciate the exemplary purpose of FIG. 5 and understand that the present invention is operable to utilize a wide variety of intervals and that these time intervals are manipulatable, and times at which the major chambers are not connected to the pump are variable to change the ratio from ⅔ to any conceivable ratio of time. Therefore, the present invention is operable to utilize variable suction intervals to achieve any desired even or uneven thickness. Additionally, while the graph of the circuit states illustrated in FIG. 5 describes only two different intervals (i.e., suction to the minor chambers represented by asynchronous intervals 54 and suction to both chambers represented by synchronous intervals 52) one of ordinary skill in the art will appreciate that where more than two suction lines and chambers are used, more than two different intervals are usable by the present invention. As a nonlimiting example, the suction mold device includes three suction lines connected to three different chambers. Each of the three suction lines includes an automatic shut-off valve connected to the control device. The control device connects each suction line with the pump and is configured to wirelessly actuate the automatic shut off valve for each of the three suction lines both individually and simultaneously for a plurality of suction lines. In this nonlimiting example, there are more than two intervals, representing suction to any one or any combination of chambers. In this way, the process of the present invention is operable to be adapted to suit the desired characteristics of a variety of molded fiber product types, which may require more or less chambers than the embodiments specifically disclosed herein, but which are considered to be within the scope of the present invention.

Pressing Process

In one embodiment, upon finishing the molding process, the molded fiber product is pressed and/or heated to remove any remaining moisture, increase its strength, and provide for smoothened surfaces. In one embodiment, the molded fiber products are not pressed. In one embodiment, the product is dried without pressing (e.g., air-drying, temperature-based drying). In one embodiment, the molded fiber products are not pressed or heated. In one embodiment, the product is dried without heating. One of ordinary skill in the art will appreciate that there are a range of drying techniques known in the art which are operable to be incorporated into the process of the present invention in order to dry the molded fiber product without using a pressing step, a heating step, or a vacuum drying process.

In one embodiment, during the pressing process, the molded fiber products are impregnated with a biodegradable, cured substance that locally reinforces the molded fiber. Examples of such substances include but are not limited to carnauba, beeswax, shellac, and/or sugar cane wax. One of ordinary skill in the art will appreciate that the present invention permits the inclusion of a variety of usable biodegradable substances known in the art not listed to reinforce the molded fiber. In one embodiment, the pressing process does not include impregnation of the molded fiber products.

In one embodiment, the invention includes an inflatable pressing member that is inserted into the opening of the cavity created when the suction mold device is closed. In one embodiment, the inflatable pressing member is inflated with liquid and/or air. As the inflatable pressing member expands, the fiber is pressed against the porous walls of the suction mold device. The expansion of the pressing member pressing results in excess water being pressed out of the fibers while in the suction mold device. The suction mold device, in this embodiment, is removed from the pulp slurry during this process as it continues to vacuum the water out of the pulp slurry during this process. In one embodiment, the suction mold device is kept in the pulp while the inflatable pressing member is inserted into the cavity. In this embodiment, the suction mold device uses the vacuum to pull the inflatable pressing member towards the porous walls, thereby not requiring the use of liquid or air to fill the inflatable pressing member. In one embodiment, the inflatable pressing member uses material including, but not limited to, urethane, fluorine or silicone rubber, or elastomers. One of ordinary skill in the art will appreciate that any material of high tensile strength, impact resilience, and elasticity known in the art is usable for the inflatable pressing member of the present invention. In one embodiment, the inflatable pressing member is not elastic (e.g., a hollow bag). In one embodiment, the inflatable pressing member is inserted into the cavity to press the fiber to the porous walls. In this embodiment, the pressing member is made of materials including, but not limited to, a polyethylene film, polypropylene film, a synthetic resin film having aluminum or silica deposited, a synthetic resin film laminated with aluminum foil, paper, or fabrics. In one embodiment, the pressing member is equal to or greater in size than the shape of the porous walls. In one embodiment, the pressing member is kept inside as a liner for the molded fiber device. This advantageously removes the need for a coating process, as the inflatable pressing member replaces the coating process.

In one embodiment, the fluid fed into the inflatable pressing member is composed of compressed air, oil, and other liquids. In one embodiment, the pressure for the fluid feed is about 10 atm to about 50 atm. In one embodiment, the pressure for the fluid feed is about 1 atm to about 10 atm. In one embodiment, the pressure for the fluid feed is about 1 atm to about 50 atm. In one embodiment, the fluid is heated to shorten the drying time of the molded fiber product while being pressed. In one embodiment, the molded fiber product is removed from the suction mold device and placed into a separately prepared heating mold formed to the contours of the molded fiber product. In one embodiment, the separately prepared heating mold is a split mold composed of plurality of heating mold subcomponents that are combined to conform to the contours and shape of the molded fiber product. The separately prepared heating mold is then heated to a predetermined temperature, wherein the molded fiber product is placed and dried under heat. In one embodiment, the heat drying is accelerated by inserting a pressing member or similar to the inflatable pressing member to press the molded fiber product onto the heating mold. This process enables the drying time to be significantly shortened compared to oven drying. The heat drying, combined with the pressing member, simultaneously expels water from the molded fiber product, smoothens the surfaces of the molded fiber product, and dries the molded fiber product.

In one embodiment, the inflatable pressing member is inflated using a heating device acting as a compressor. The heating device heats a gas or fluid, such as a liquid, including hot oil, to a temperature between about 100 to 300 degrees Celsius. The heating device further pressurizes the gas or fluid. The hot, pressurized fluid is then delivered to the inflatable pressing member to deliver a compressive force to the mold. In one embodiment, the force delivered to the mold is sufficient to press against the porous walls of the suction mold device without damaging the structural integrity of the pulp itself. In one embodiment, the force delivered to the mold is between about 1 atm to about 100 atm. When force is applied by the inflatable pressing member, the excess moisture in the pulp is pressed out through the porous walls and sucked in by the pump, thereby drying the fiber mold. Further, the temperature of the heated gas or fluid evaporates the moisture of the pulp, speeding the drying process. In one embodiment, the inflatable member is preheated before it contacts the pulp, thereby increasing the difference in temperature between the inflatable pressing member and the pulp resulting in a super-heating of the moisture of the pulp and a shorter drying process.

In one embodiment, the molded fiber product is pressed again after finishing the coating process. This permits the molded fiber product to have a greatly increased strength and integrity for longer term storage of contents.

In one embodiment, the pulp, during the pressing process, is vacuum dried to a moisture content of about 55% to 80%.

Coating Process

In one embodiment, after the molded fiber product has been molded and pressed, the molded fiber product is coated to prevent the degradation of the product by liquids or other contents destructive to the fiber. In one embodiment, the coating is a biodegradable material including, but not limited to, cellulose fibers, casein, whey, agar-agar, and/or *psyllium* husks. However, one of ordinary skill in the art will appreciate that any suitable biodegradable material known in the art may be used alone or in combination to create the coating for the molded fiber product. In one embodiment, the coating is made of a suitable nonbiodegradable material known in the art, such as polymers. In one embodiment, the coating is a food grade coating according to the Food and Drug Administration (FDA), the European Food Safety Authority (EFSA), or any similar governing body associated with regulating food safety protocols. In one embodiment, the coating material used changes depending on the contents intended to be kept within the molded fiber product. As a nonlimiting example, coating materials with a higher resistance to acidity are used for containers holding orange juice, creams, etc.

In one embodiment, the coating of the fiber-molded product includes, but is not limited to, spraying a coating solution on the product in the suction mold, in a press mold, a counter mold and/or in a separate coating station. In one embodiment, the fiber-molded product is immersed in a coating solution for coating or doused or rinsed with a coating solution. In one embodiment, the present invention is operable to use any coating method known in the art to protect the molded fiber product from damage. In one embodiment, the present invention utilizes the coating composition and/or method disclosed in US Patent Pub. No. 2022/0259805, incorporated herein by reference in its entirety.

In one embodiment, a centripetal spinner is used to uniformly coat the molded fiber product and/or remove excess coating from the molded fiber product. A coating material is applied to the product (e.g., a concave section of the product). A high rotational speed is applied to a molded fiber product with the coating material applied. This high rotational speed results in centripetal force acting upon the surface tension of the liquid to spread the coating. In one embodiment, this force is used to coat the product, creating an even, thin layer of coating around the molded fiber product. In one embodiment, this force is used to remove excess coating from the product. The coating liquid is poured in a concave section of the article, then poured out. With the concave surface facing away from the axis of rotation, the article is spun so that excess coating is centrifuged away from the surface. This spin coating on fiber products advantageously ensures an even distribution of coating material on the product, such that the product is fully protected, with complete removal of the coating material. The coating of the molded fiber product resulting from the removal of excess coating material via a centripetal spinner has a thickness ranging from about 5 μm to 300 μm. In another embodiment, another coating method is used after the spin coating to further reinforce the coating of the molded fiber product, thereby ensuring its strength and durability as a product for water or other viscous contents.

In one embodiment, portions of the molded fiber product are selectively coated, while omitting coating of other portions of the molded fiber product. As a nonlimiting example, the inner section of the molded fiber product where contents are kept is coated, while the outer section of the molded fiber product is not coated. This advantageously allows for more economical manufacturing of the molded fiber product, by only coating the necessary portions of the product.

Use Cases

The molded fiber product created with the suction mold device 10 is usable in a wide variety of cases. These include but are not limited to bottles with threaded necks, coffee pods, a razor handle, and containers for cosmetic ointments and creams, medical ointments and creams, solid food, liquid food, water, and/or frozen foods. Further, the thin-walled product resulting from the production process of the present invention is useful for a variety of applications specific to fiber molded articles with thin walls, such as cutlery (e.g. knife, fork, spoon) and blister packs for the distribution and dispensation of various items (e.g., gum, medication). One of ordinary skill in the art will appreciate that the molded fiber products is useful for a variety of applications, and particularly in place of plastic for applications which traditionally utilize plastic components or products.

Figure 6:
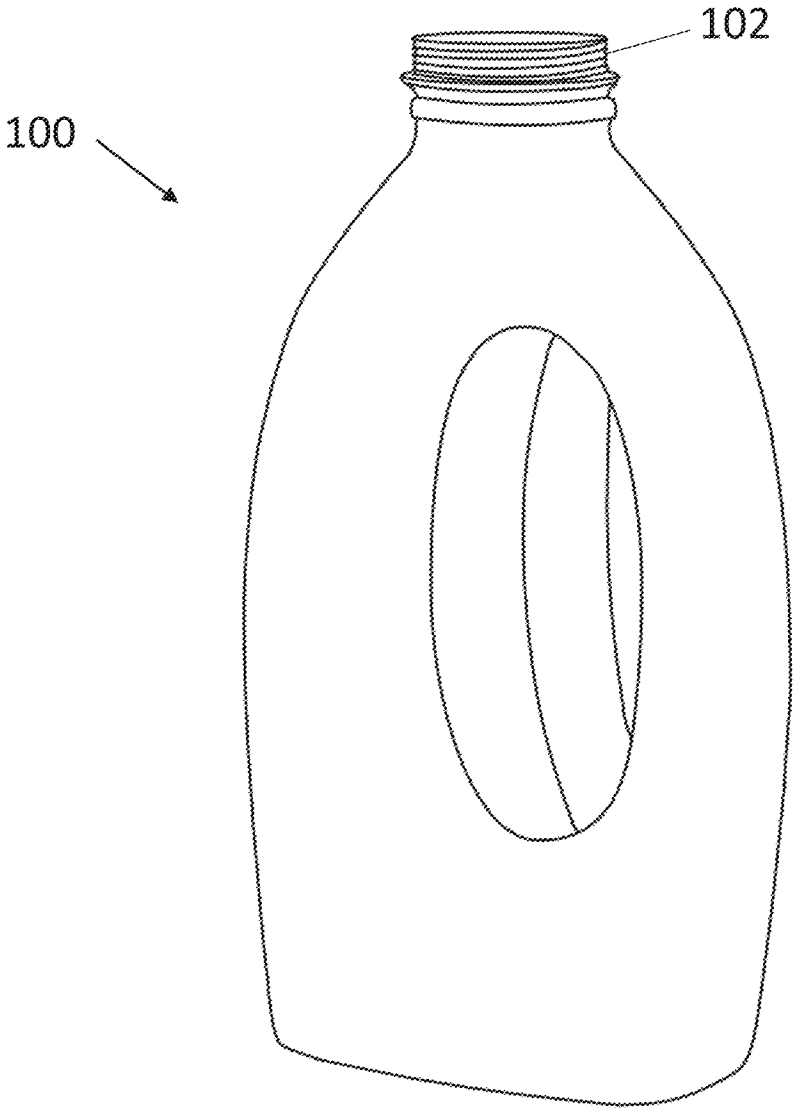
FIG. 6 illustrates a perspective view of a molded fiber product according to one embodiment of the present invention.

FIG. 6 illustrates a perspective view of a bottle with a threaded neck according to one embodiment of the present invention. The bottle 100 includes a threaded neck 102 formed from the suction mold device of the present invention. In one embodiment, a biodegradable threaded neck support is embedded in the threaded neck of the bottle as disclosed herein. In one embodiment, the cavity of the suction mold device includes a threaded portion at the neck of the product. In one embodiment, the vacuum suction within the threaded neck portion of the device is a higher pressure than the body of the product, creating two distinct vacuuming rates. In this way, the threaded neck of the bottle is operable to be made of a greater thickness than the body of the product, increasing the strength and durability of the product.

Figure 7A:
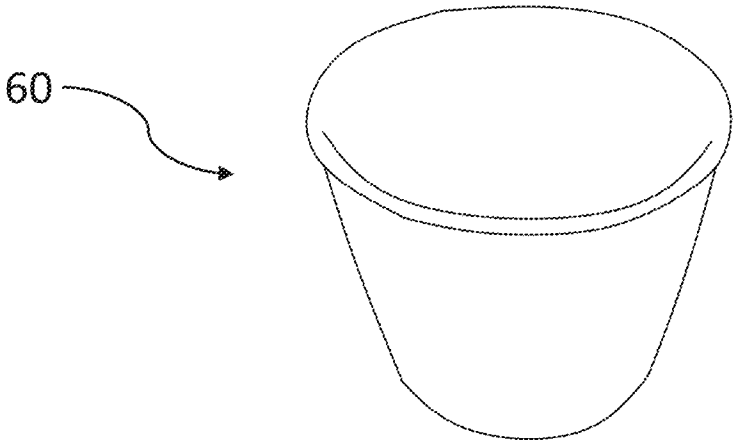
FIG. 7A illustrates a perspective top view of a molded fiber product according to one embodiment of the present invention.
Figure 7B:
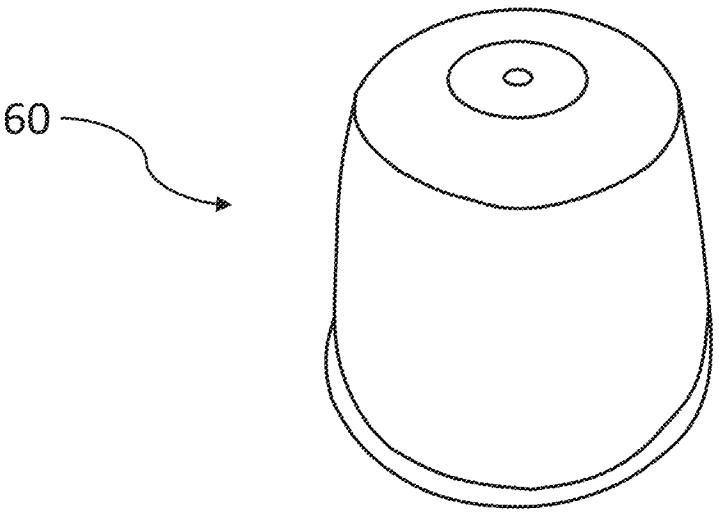
FIG. 7B illustrates a perspective bottom view of a molded fiber product according to one embodiment of the present invention.
Figure 8:
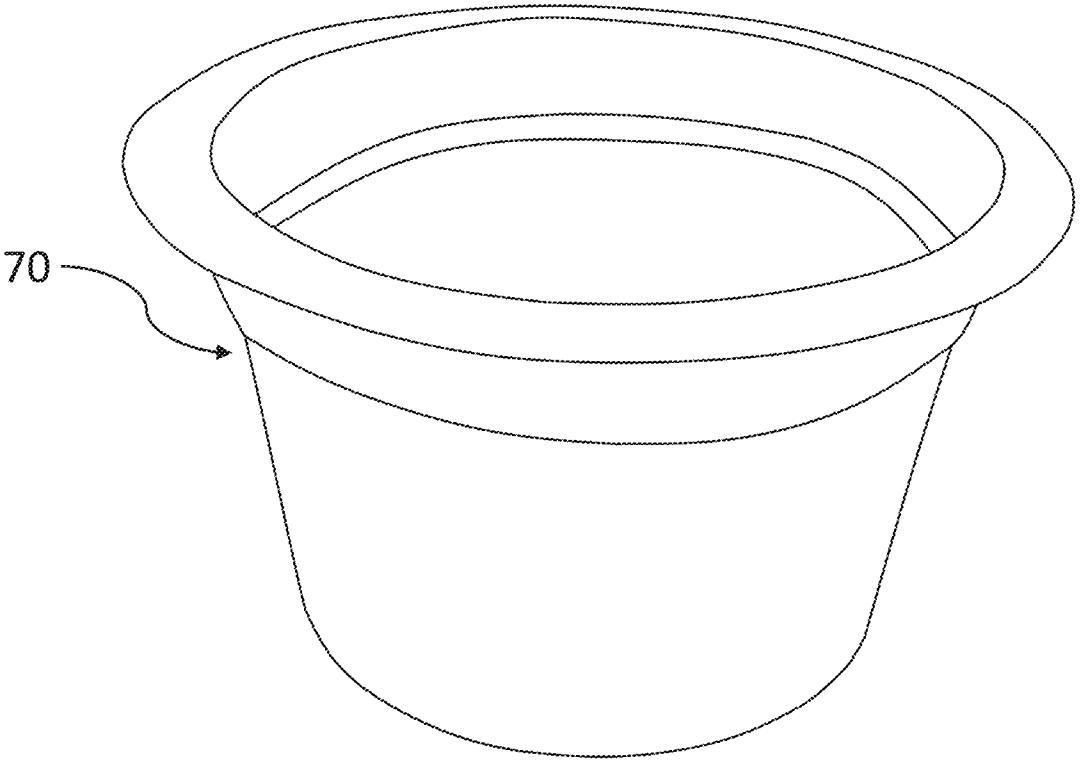
FIG. 8 illustrates a perspective top view of a molded fiber product according to one embodiment of the present invention.

FIGS. 7A, 7B, and 8 illustrate a single-use molded fiber coffee pod according to one embodiment of the present invention.

The suction mold device creates a fiber coffee pods 60, 70. This fiber coffee pods 60, 70 come in a variety of form factors to accommodate for a variety of different types of coffee makers. These form factors include, but are not limited to, 18 oz., 7.77 oz., 5.07 oz., 2.07 oz., and 1.35 oz. However, one of ordinary skill in the art will appreciate that any size coffee pod is manufacturable by the suction mold device by modifying the shape and size of the cavity. In one embodiment, the fiber coffee pods are pressed after molding to smooth the surfaces and increase its strength for use during making coffee. In one embodiment, the pods are additionally coated using the coating processes previously disclosed. In another embodiment, the pods are not coated and/or not pressed, such that the fiber-molded product creation process is complete upon finishing the fiber molding process with the suction mold device.

Figure 9:
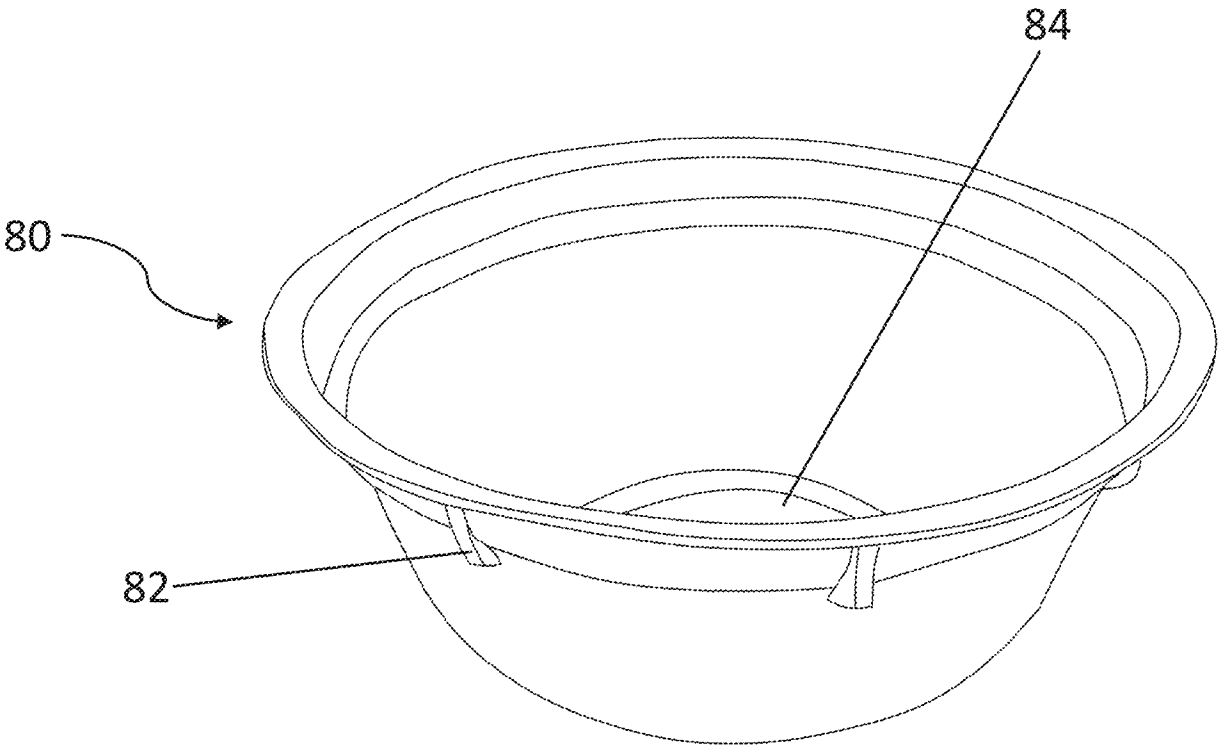
FIG. 9 illustrates a perspective top view of a molded fiber food bowl according to one embodiment of the present invention.

FIG. 9 illustrates a fiber-molded bowl 80 according to one embodiment of the present invention. The fiber-molded bowl 80 includes a convex bottom 84 and support arches 82 to strengthen the integrity of the fiber-molded bowl 80 during use.

The fiber-molded bowl is created using the molding process and pressing process described previously. Further, the fiber-molded bowl is coated using the coating process described previously. In one embodiment, the fiber-molded bowl is not coated. In one embodiment, the convex bottom and support arches are thicker than the other portions of the fiber-molded bowl. In order to achieve this configuration, the fiber-molded bowl undergoes the variable circuit process described in FIG. 5. utilizing the major chambers and minor chambers to produce independently pressured regions in the suction mold device. In one embodiment, the minor chambers are associated with the support arches and/or convex bottom, while the major chambers are associated with the remaining portions of the fiber-molded bowl.

In one embodiment, the fiber-molded bowl is of a thickness and durability to contain frozen foods and withstand a microwave, such that the frozen foods may be defrosted, cooked, or warmed in a microwave using the fiber-molded bowl. In one embodiment, the fiber-molded bowl includes a biodegradable lid for microwaving and/or storing. The biodegradable lid is made of materials including, but not limited to, the same pulp material used in the molding process of the fiber-molded bowl and/or other microwave-safe biodegradable material known in the art. In another embodiment, the fiber-molded bowl is operable to contain ice cream or other similar frozen products without degradation.

Figure 10:
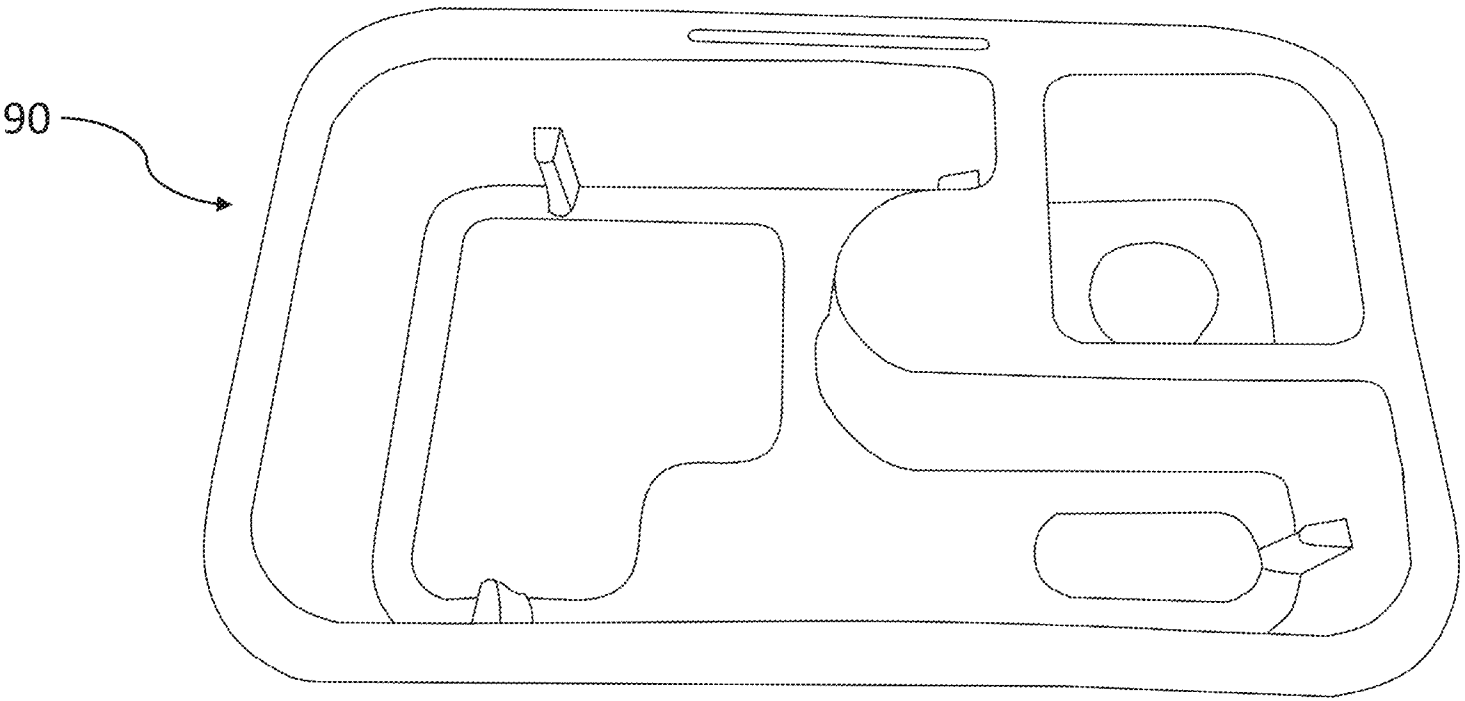
FIG. 10 illustrates a perspective top view of a molded fiber food tray according to one embodiment of the present invention.

FIG. 10 illustrates a fiber-molded food tray 90 according to one embodiment of the present invention.

The fiber-molded tray is created using the molding process and pressing process described. In one embodiment, the bottom of the fiber tray is thicker than the rest of the tray by using the selective wall thickening methods described. Further, the fiber-molded tray is coated using the coating process described. In one embodiment the fiber-molded tray is not coated. In one embodiment, the fiber-molded tray contains frozen foods. In one embodiment, the fiber-molded tray is microwavable and contains a biodegradable, removable film. This biodegradable, removable film is used to ensure the quality of the frozen food when being microwaved. In another embodiment, the fiber-molded tray is used to contain dry foods and/or wet foods, such that the fiber tray is either stored in a refrigerated or a nonrefrigerated environment.

In one embodiment, the molded fiber product is used to package electronics. In one embodiment, the fiber product is not pressed or coated after being molded in the suction mold device. In this embodiment, the fiber product finishes its manufacturing process after being molded and is dried using air drying or another similar method. In another embodiment, the electronics product is pressed and/or coated to better protect the device.

Figure 11:
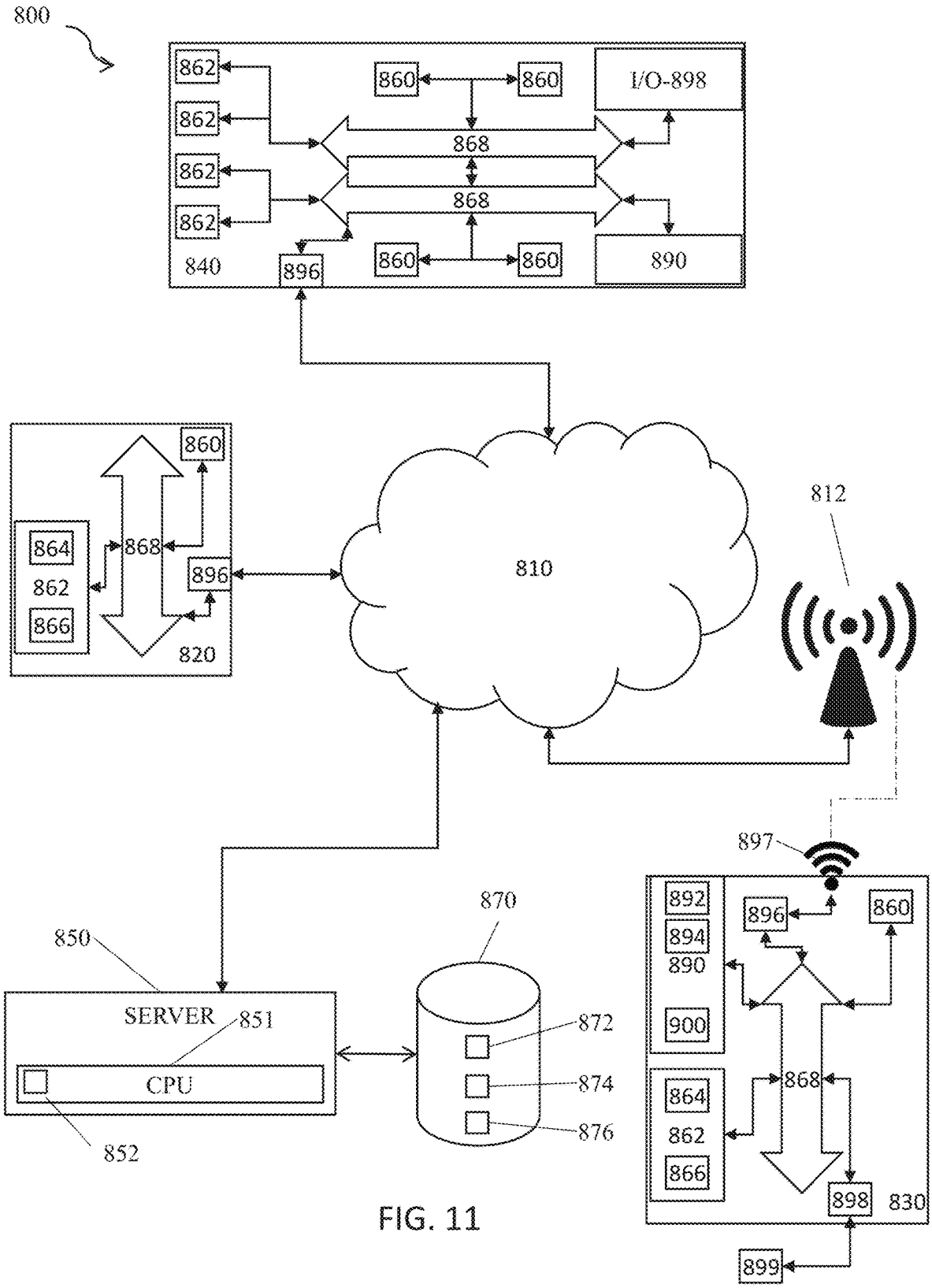
FIG. 11 is a schematic diagram of a system of the present invention.

FIG. 11 is a schematic diagram of an embodiment of the invention illustrating a computer system, generally described as 800, having a network 810, a plurality of computing devices 820, 830, 840, a server 850, and a database 870. The present invention is operable to be controlled via a control device as disclosed herein. In one embodiment, the process of the present invention is automated through the use of the control device, which is in remote connection with the tooling as disclosed herein. In one embodiment, the tooling of the present invention (e.g., the suction mold device, heating mold, inflatable pressing member) includes a computing device capable of receiving commands from the control device as disclosed herein.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, gaming controllers, joy sticks, touch pads, signal generation devices (e.g., speakers), augmented reality/virtual reality (AR/VR) devices (e.g., AR/VR headsets), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 11, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 11, is operable to include other components that are not explicitly shown in FIG. 11, or is operable to utilize an architecture completely different than that shown in FIG. 11. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A molded fiber product produced using a split mold device, comprising:

a threaded neck portion and a hollow body;

wherein the molded fiber product comprises a natural fiber composition;

wherein the split mold device is configured to deliver negative pressure to a cavity of the split mold device via a first chamber and a second chamber, wherein the molded pulp product is formed within the cavity, and wherein the first chamber and the second chamber are connected to a negative pressure source with a first suction line and a second suction line;

wherein the molded fiber product is fully dried without heat within the cavity;

wherein the hollow body and the threaded neck portion are of varying wall thickness, such that a wall of the threaded neck portion is of a different thickness than a wall of the hollow body, and wherein the wall of the hollow body is thinner than the wall of the threaded neck portion;

wherein the hollow body has a substantially similar density throughout the hollow body; and wherein the threaded neck portion is unitary and integrally formed as part of the molded pulp product, and wherein the threaded neck portion does not degrade when exposed to a liquid.

2. The product of claim 1, wherein a thickness of the threaded neck is not formed by folding a portion of the molded fiber product.

3. The product of claim 1, wherein the threaded neck is not formed by the insertion of a connecting element into the molded fiber product.

4. The product of claim 1, wherein the split mold device is configured for remote connection with a control device, wherein the split mold device is operable to be automatically controlled via the control device.

5. The product of claim 1, wherein the molded fiber product undergoes a pressing process within the split mold device.

6. The product of claim 1, wherein the molded fiber product undergoes a drying process within the split mold device.

7. The product of claim 1, wherein the natural fiber composition comprises at least one natural fiber selected from the group consisting of wood, hemp, sweetgrass, bamboo, flax, jute, and straw.

8. The product of claim 1, wherein the natural fiber composition does not contain recycled fibers.

9. The product of claim 1, wherein the molded pulp product is coated, wherein a coating used to coat the molded pulp product comprises at least one ingredient selected from the group consisting of carnauba wax, beeswax, shellac, and sugar cane wax.

* * * * *